US005813773A

United States Patent [19]

Kawai

[11] Patent Number: 5,813,773

[45] Date of Patent: Sep. 29, 1998

[54] TAPE CASSETTE

[75] Inventor: Takamitsu Kawai, Nagoya, Japan

[73] Assignee: Brother Kogyo Kabushiki Kaisha, Nagoya, Japan

[21] Appl. No.: 795,133

[22] Filed: Feb. 7, 1997

[30] Foreign Application Priority Data

Feb. 16, 1996 [JP] Japan ..... 8-029115

[51] Int. Cl.[6] ..... B41J 35/28

[52] U.S. Cl. ..... 400/207; 400/208

[58] Field of Search ..... 400/207, 208, 400/247, 248, 227.2

[56] References Cited

U.S. PATENT DOCUMENTS

| | | | |
|---|---|---|---|
| 4,536,098 | 8/1985 | Sheehan et al. | 400/208 |
| 4,927,278 | 5/1990 | Kuyuya et al. | 400/208 |
| 5,188,469 | 2/1993 | Nagao et al. | 400/208 |
| 5,350,243 | 9/1994 | Ichinomiya et al. | 400/208 |

FOREIGN PATENT DOCUMENTS

| | | |
|---|---|---|
| 0 034 026 A | 8/1981 | European Pat. Off. . |
| 0 161 775 A | 11/1985 | European Pat. Off. . |
| 0 604 142 A | 6/1994 | European Pat. Off. . |
| 0 684 143 A | 11/1995 | European Pat. Off. . |
| 30 05 260 A | 8/1981 | Germany . |

*Primary Examiner*—Edgar S. Burr
*Assistant Examiner*—Anthony H. Nguyen
*Attorney, Agent, or Firm*—Oliff & Berridge, PLC

[57] ABSTRACT

Two column-shaped ribs are disposed between a ribbon spool and an inner wall of a lower case in a cassette case. When a film tape is an ink-receiving type, which needs an ink ribbon, a pathway traveling to the outside of the ribs is selected so that the film tape traveling through the case can be reliably prevented from contacting the ink ribbon wound around the ribbon spool. On the contrary, when the film tape is a heat-sensitive type, wherein printing is performed by a thermal head directly heating the film tape, a pathway which travels between the ribs is selected so that the tape can be prevented from being drawn back when the tape is flexible like paper.

26 Claims, 4 Drawing Sheets

TAPE CASSETTE

BACKGROUND OF THE INVENTION

1. Field of the Invention

The present invention relates to optimizing a tape pathway of a tape cassette used in a label printer and the like.

2. Description of the Related Art

There have been proposed various types of tape cassettes used in a tape-printing device for producing a tape printed with characters. The tape cassettes generally include a ribbon spool, around which an ink-transposing ribbon is wound, and a film tape spool, around which an ink receiving film tape, serving as a printing medium, is wound. Both are housed in a cassette case. To produce a tape printed with characters, the ink ribbon and the film tape are fed out in synchronization while a thermal head provided to the tape-printing device heats the ink ribbon so that the ink on the ink ribbon is melted in the form of characters and the like and then transposed onto the film tape.

A heat-sensitive film tape, which does not need the ink ribbon, can also be used as the printing medium. In this case, the thermal head directly heats up a portion of the film tape when the heat-sensitive film tape is being fed. The heated portion of the thermal head is in the shape of characters and the like so that the tape is printed with the characters.

The cassette case for housing the ink-receiving tape and the ink ribbon is the same as that for housing the heat-sensitive tape. In other words, each tape described above is separately housed in a common, but separate, cassette case. The tapes also follow the same pathway through the cassette case.

SUMMARY OF THE INVENTION

However, the different types of tape have different stiffness, thickness, and frictional force. Because of this, printing may not be performed smoothly in a common running pathway.

For example, when the tape is stiff, or thick because a chemical and the like is coated on its surface, a greater force is required to draw the tape through a point along the pathway where the tape is guided to be bent into a substantially acute angle. As a result, the tape will be printed on without being sufficiently drawn out. Proper printing can not be achieved. This problem occurs especially with tapes which generate a large frictional force. On the other hand, when the tape is flexible like paper, or extremely thin, if there is no point along the pathway where the tape is guided to be bent into a substantially acute angle, then only slightly tilting or vibrating the tape-printing device could cause the tape to bend in the pathway. This could cause the tip of the tape to be pulled back into the cassette case so that printing can not be performed. Further, when the tape has a peel-off sheet and is stiff or thick, if there is a point on the running pathway where the tape is guided to be bent into a substantially acute angle, the peel-off sheet may peel away from the tape at the bent point.

Conventionally, a plurality of different cassette cases have been manufactured, each with a transport pathway suitable for the type and quality of tape housed in the case. However, it is extremely expensive to design and produce such a variety of different cassette cases.

It is an objective of the present invention to overcome the above-described problems and to provide a tape cassette wherein a suitable running pathway can be selected according to the type of the tape.

To achieve the above-described objective, a tape cassette described according to the present invention is detachably provided to a printing device and housing, in a wound-up condition, a tape of a type from a plurality of types of elongated tapes, and includes a plurality of pathways each corresponding to one of the plurality of types of elongated tapes, the tape following a corresponding one of the plurality of pathways to be discharged from the tape cassette.

With this configuration, the tape cassette is detachably provided to a printing device and houses an elongated and wound-up tape. The tape is fed through a predetermined pathway in the cassette case before being discharged. The tape cassette includes a plurality of pathways from which a pathway is selected according to a type of the tape. Therefore, a pathway can be selected by taking the characteristics of the tape into consideration so that conventional problems caused by using a common pathway can be reliably prevented. Also, tape cassettes with the same design can be used to house a variety of different types of tapes. By merely changing the transport pathway through which a housed tape runs, the same cassette can be used to house any of a variety of different type tapes. Because the same cassette case can be used, the cassette case is less costly to produce while still providing transport pathways that suit the needs of all the tape types. The transport pathway for a particular tape type can be selected by threading the tape along the desired transport pathway when the cassette is first assembled in the factory or when the user replaces a spent tape with a new one.

According to another aspect of the present invention a tape cassette includes a guide member for guiding the tape. A plurality of pathways for guiding the tape from its supply source to its discharge port includes a first pathway, wherein the tape is guided to bend in a substantially acute angle, and a second pathway, wherein the tape is guided to bend in a substantially obtuse angle. Therefore, by selecting the first pathway or the second pathway by taking into consideration the characteristics of the tape, conventional problems caused by using a common pathway can be reliably prevented.

According to a further aspect of the invention, a tape cassette is configured so that the second pathway is selected when the tape is stiff. Therefore, the tape can be smoothly drawn out and problems, such as poor printing caused by the tape being insufficiently drawn out, can be reliably prevented.

According to a still further aspect of the present invention, the tape cassette is configured so that the first pathway is selected when the tape is flexible. Therefore problems which prohibit printing, such as the tape being bent along the pathway so that the tip of the tape is drawn back into the cassette case, can be reliably prevented.

According to another aspect of the invention, the tape cassette is configured so that the second pathway is selected when the tape has a peel-off sheet. Therefore, the tape can be prevented from being guided to be bent into an acute angle in the pathway and the peel-off sheet can be reliably prevented from being peeled off.

According to a still further aspect of the present invention, the tape cassette is configured with the guide member being configured from two column members provided in the vicinity of an ink-transposing ribbon spool housed in the cassette case. The guide member guides the tape into a substantially acute angle in the first pathway by guiding the tape between the two column members and into a substantially obtuse angle in the second pathway by guiding the tape to the outside of both of the column members. According to this configuration, the first pathway and the second pathway can be formed with a simple configuration.

According to a further aspect of the present invention, the tape cassette is configured so that the first pathway is selected when the tape is a heat-sensitive type not requiring an ink-transposing ribbon and so that the second pathway is selected when the tape is an ink-receiving type requiring an ink-transposing ribbon. Therefore, the tape running through the cassette case can be reliably prevented from contacting the ink-transposing ribbon.

BRIEF DESCRIPTION OF THE DRAWINGS

The above and other objects, features, and advantages of the invention will become more apparent from reading the following description of the preferred embodiment taken in connection with the accompanying drawings in which.

DETAILED DESCRIPTION OF THE EMBODIMENT

Figure 1:
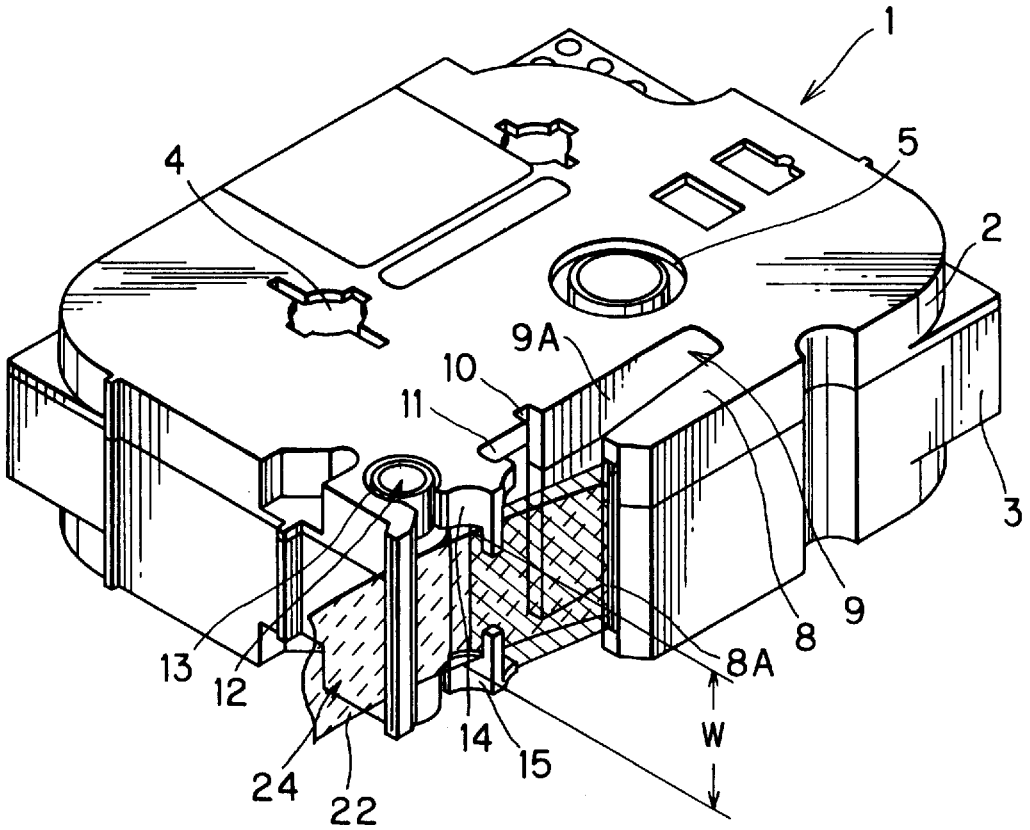
FIG. 1 is a perspective view showing a tape cassette according to the present invention.

A tape cassette according to a preferred embodiment of the present invention will be described while referring to the accompanying drawings wherein like parts and components are designated by the same reference numerals to avoid duplicating description.

Figure 2:
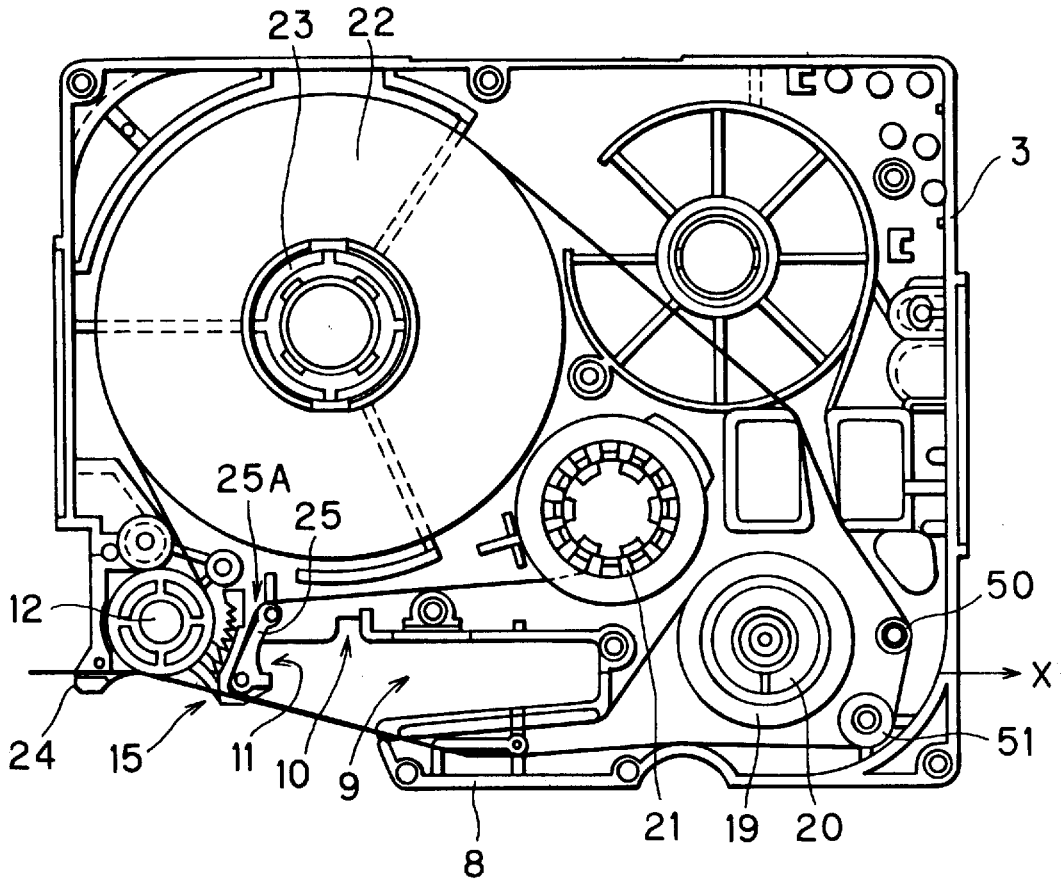
FIG. 2 is a plan view showing a lower case of the tape cassette with an upper cause of the tape cassette detached, the tape cassette hosing an ink-receiving type tape that follows a second pathway through the tape cassette.
Figure 3:
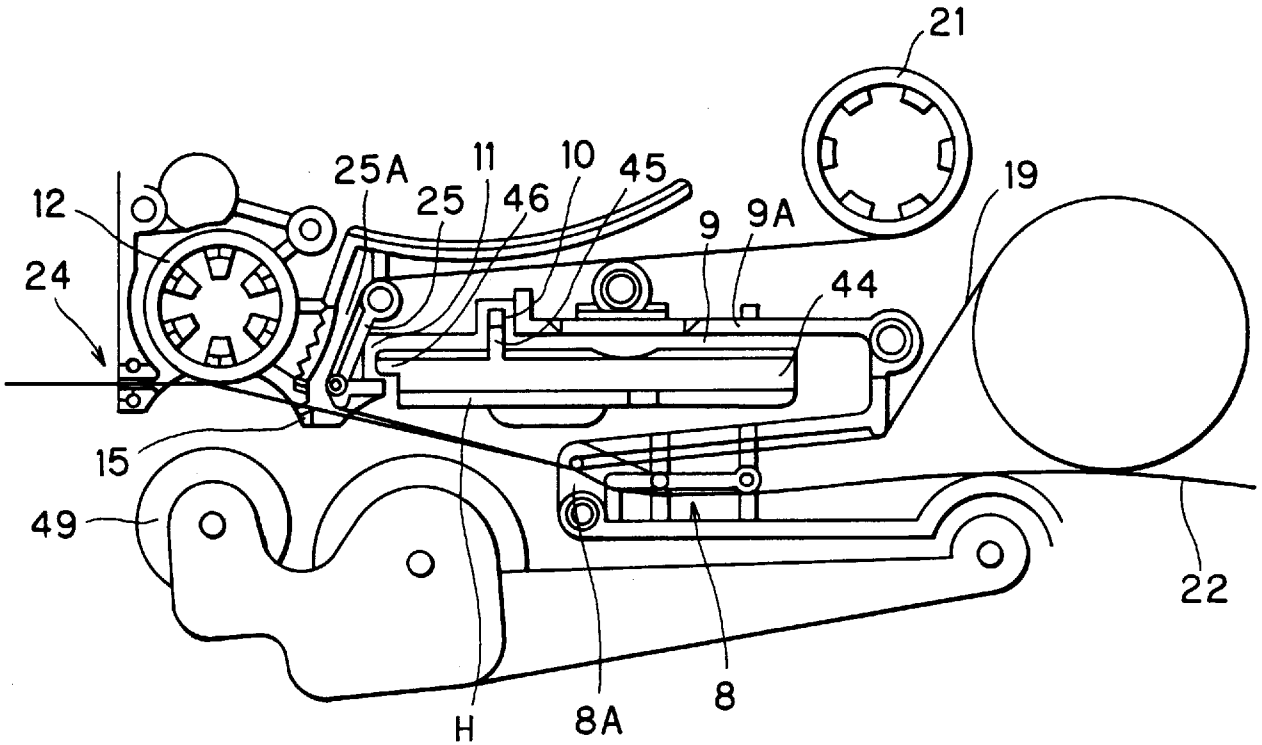
FIG. 3 is a magnified view showing a relationship between a tape of the tape cassette and a head holder for a thermal head when the tape cassette is mounted on a cassette mounting portion of a tape-printing device.

First, the schematic configuration of a tape cassette 1 will be explained. FIG. 1 is a perspective view showing the tape cassette 1. As shown in FIG. 1, the tape cassette 1 of the present embodiment includes an upper case 2 and a lower case 3. FIG. 2 is a plan view showing the tape cassette 1 when the upper case 2 is detached. FIG. 3 is a magnified view showing a relationship between a tape of the tape cassette and a thermal head holder of a tape printing device when the tape cassette 1 is mounted on a cassette mounting portion of the tape printing device.

The tape cassette 1 is formed with a support hole 4 and a support hole 5. The support hole 4 rotatably supports a tape spool 23 around which is wound a film tape 22, on which characters and the like are to be printed. The support hole 5 supports a ribbon take-up spool 21. When using a thermal head H to print characters and the like on the film tape 22, the ribbon take-up spool 21 draws out and winds up an ink ribbon 19 from a ribbon spool 20.

It should be noted that although FIG. 1 only shows the support holes 4 and 5 formed in the upper case 2, support shafts are formed in the lower case 3 in confrontation with each support hole formed in the upper case 2. The film 22 is an ink-receiving type printed on with ink from the ink ribbon 19.

An arm portion 8 is provided on the front side of the tape cassette 1, that is, the lower side in FIG. 1. The arm portion 8 is for guiding, toward an opening 8A, the film tape 22 drawn from the tape spool 23 and the ink ribbon 19 drawn from the ribbon spool 20. A head mounting opening 9, wherein the thermal head H of the tape printing device is inserted, is formed in a head mounting portion at the rear of the arm portion 8. In a wall portion 9A confronting the arm portion 8 of the head mounting opening 9, a first engagement portion 10 is formed extending toward the rear of the tape cassette 1. In the left side wall of the head mounting opening 9, a second engagement portion 11 is formed extending perpendicular to the first engagement portion 10, that is, extending in a direction following the wall portion 9A. Two protrusion portions 45 and 46 are formed on a head holder 44, which supports the thermal head H. The protrusion portions 45 and 46 are fitted into the engagement portions 10 and 11 respectively so that the thermal head H can be inserted into the head mounting opening 9 without interfering with the ink ribbon 19 and the film tape 22.

A tape-feed roller 12 is rotatably supported in the support hole 13 at a position downstream from the head mounting opening 9 with respect to a feed direction of the ink ribbon 19 and the film tape 22. The tape-feed roller 12 draws the film tape 22 from the tape spool 23 in cooperation with a pressing roller 49, which presses against the tape-feed roller 12 from the opposite side. The tape-feed roller 12 also draws the film tape 22, on which the thermal head H has printed characters and the like via the ink ribbon 19, out of the tape cassette 1. An upper and lower pair of regulating members 14, 15 are provided at a position near the tape-feed roller 12. Each regulating member 14, 15 guides the film tape 22, on which characters and the like have been printed, to regulate its movement in the width direction of the film tape 22 at a position downstream from the thermal head H. It should be noted that a width W (see FIG. 1) between the upper regulating member 14 and the lower regulating member 15 is set to the same width as the width of the film tape 22.

Next, an explanation will be provided for the internal configuration of the tape cassette 1 while referring to FIG. 2. As shown in FIG. 2, the tape spool 23 around which the film tape 22 is wound is rotatably provided in the support hole 4 at the rear portion of the lower case 3, that is, at the upper left portion in FIG. 2. The ribbon spool 20, around which the ink ribbon 19 is wound, is rotatably provided to the front portion of the lower case 3, that is, the lower right in FIG. 2. The ribbon take-up spool 21 for drawing fresh ink ribbon 19 from the ribbon spool 20 and winding spent ink ribbon 19 used for printing characters and the like is rotatably provided in the support hole 5 between the tape spool 23 and the ribbon spool 20.

The film tape 22 is drawn from the tape spool 23 by cooperation between the tape-feed roller 12 and the pressing roller 49, which is provided to the tape printing device. The film tape 22 then passes through the front side of the head mounting opening 9, that is, the lower left in FIG. 2, from the opening 8A of the arm portion 8. The film tape 22 is finally discharged out of the tape cassette 1 from a tape discharge portion 24. The ink ribbon 19 is drawn from the ribbon spool 20 by the ribbon take-up spool 21, then passes through the front side of the head mounting opening 9, that is, at the lower portion in FIG. 2 from the opening 8A of the arm portion 8, and is finally wound up on the ribbon take-up spool 21 through a guiding hole 25A of a guiding portion 25 formed to the interior of the tape cassette 1 with respect to regulating members 14, 15.

Two column-shaped ribs 50, 51 are provided between the ribbon spool 20 and the inner wall of the lower case 3. When the film tape 22 is an ink-receiving type, which needs the ink ribbon 19, it follows a second pathway through the tape cassette 1 as shown in FIG. 2. The second pathway passes to the outside of the both of the ribs 50 and 51 with respect to the ink ribbon spool 20. In this way, the film tape 22 running through the case can be reliably prevented from interfering with the ink ribbon 19 wound around the ribbon spool 20. Especially, because the film tape 22 is guided through the second pathway so as to be bent into a substantially obtuse angle by the ribs 50, 51, when the film tape 22 has a peel-off sheet, then the peel-off sheet can be prevented from peeling off during feed of the film tape 22. When a thick, stiff tape which generates a great deal of friction is used as the film tape 22, because there is no point along the second pathway where the film tape 22 is guided to be bent into an acute angle, the film tape 22 is smoothly guided so that good printing conditions can be maintained.

Figure 4:
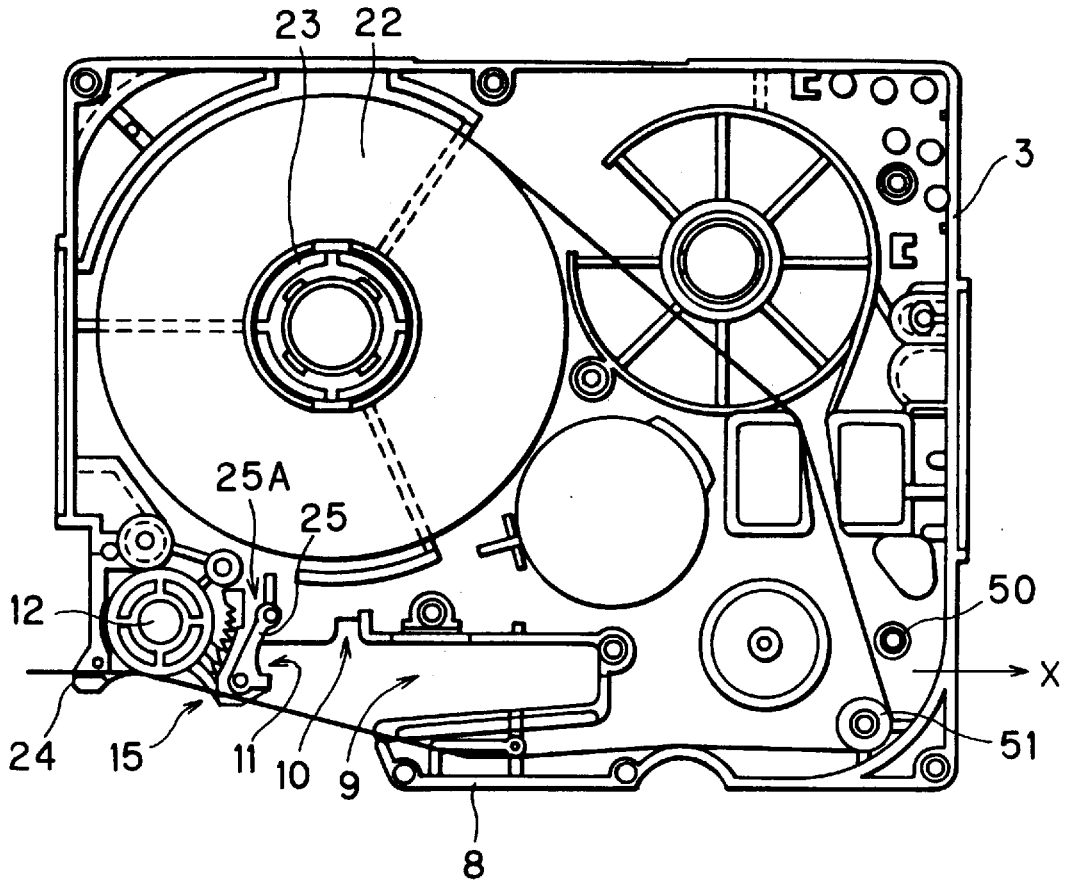
FIG. 4 is an explanatory drawing showing the tape cassette housing a heat-sensitive film tape, which does not require an ink-transposing ribbon, that follows a first pathway through the tape cassette.

On the other hand, when the film tape 22 is a heat-sensitive type, which is printed on by the thermal head H directly heating the tape, it follows a first pathway as shown in FIG. 4. The first pathway passes between the ribs 50 and 51, that is, to the interior of the rib 50 and to the outside of the rib 51 with respect to the ribbon spool 20. The first pathway is especially suitable for film tapes 22 which are thin and pliable like paper. That is to say, any slight vibration or tilt of the printing device can urge a thin, pliable tape to bend near the ribs 50, 51 in a direction represented by an arrow X in FIGS. 2 and 4. When the thin, pliable tape follows the second pathway as shown in FIG. 2, the film tape 22 follows this urging and bends in the direction X. This can cause the tip of the film tape 22 to be drawn into the cassette case 1 so that printing can not be performed. On the other hand, when a thin, soft tape travels in the first pathway, the rib 50 regulates bending of the film tape 22 in the X direction as shown in FIG. 4. Therefore, the tip of the film tape 22 can be prevented from being drawn into the cassette case so that printing can be reliably performed. It should be noted that the ribs 50 and 51 configure the guide member of the present invention.

As described above, because the tape cassette 1 of the present embodiment is configured so that the running pathway of the film tape 22 can be selected according to the type of tape, the pathway most suitable for the film tape 22 can be selected.

While the invention has been described in detail with reference to specific embodiments thereof, it would be apparent to those skilled in the art that various changes and modifications may be made therein without departing from the spirit of the invention, the scope of which is defined by the attached claims.

For example, although the ribs 50 and 51 are configured in a simple column shape in the present embodiment, the ribs 50 and 51 can be configured with members rotatably disposed around each rib 50 and 51 so that the film tape can be guided more smoothly. Also, the number of ribs is not limited to two. Three or more ribs can be provided.

As it is clear form the above explanation, a tape cassette according to the present invention includes a plurality of pathways from which a pathway is selected according to the type of tape. Therefore, a pathway can be selected taking into consideration a characteristic of the tape so that conventional problems caused by using a common pathway can be reliably prevented.

The tape cassette according to the present invention can also include a guide member for guiding the tape. In this case, the guide member guides the tape along one of a plurality of pathways for guiding the tape from its supply source to its discharge position. The plurality of pathways includes a first pathway, wherein the tape is guided to bend in a substantially acute angle, and a second pathway, wherein the tape is guided by bending in a substantially obtuse angle. Therefore, by selecting the first pathway or the second pathway taking into consideration characteristics of the tape, conventional problems caused by using a common pathway can be reliably prevented.

Further, the tape cassette can be configured so that the second pathway is selected when the tape is stiff. The tape can be smoothly drawn out and problems, such as poor printing caused by the tape being insufficiently drawn out, can be reliably prevented.

The tape cassette can be configured so that the first pathway is selected when the tape is flexible. Therefore, problems which prevent printing, such as the tape bending in the pathway so that the tip of the tape is drawn back into the cassette case, can be reliably prevented.

The tape cassette can be configured so that the second pathway is selected when the tape has a peel-off sheet. Therefore, the tape can be prevented from being guided to be bent into an acute angle on the pathway so that the peel-off sheet can be reliably prevented from being peeled off.

The guide member can be configured from two column members provided in the vicinity of an ink-transposing ribbon housed in the cassette case. The guide member guides the tape into a substantially acute angle through the first pathway to the outside of one of the two column members and into a substantially obtuse angle through the second pathway to the outside of both of the column members. According to this configuration, the first pathway and the second pathway can be formed with a simple configuration.

The tape cassette can be configured so that the first pathway is selected when the tape is a heat-sensitive type, which does not need an ink-transposing ribbon, and the second pathway is selected when the tape is an ink-receiving type, which needs an ink-transposing ribbon. Therefore, the tape traveling through the cassette case can be reliably prevented from contacting the ink-transposing ribbon.

What is claimed is:

1. A tape cassette detachably mounted to a printing device, said tape cassette housing an elongated tape in a wound-up condition, said elongated tape selected from a plurality of elongated tapes on which images are to be formed and having different characteristics including different thicknesses or different stiffnesses, the tape cassette further comprising:

a plurality of pathways including a first pathway and a second pathway both leading from a first point to a second point, the first and second pathways being different pathways from each other, the elongated tape following a predetermined one of the first and second pathways corresponding to characteristics of the elongated tape.

2. A tape cassette as claimed in claim 1, further comprising a guide member for guiding the tape through the corresponding pathway from where the tape is supplied to where the tape is discharged from the tape cassette.

3. A tape cassette as claimed in claim 2, wherein the first pathway bends the tape in a substantially acute angle and the second pathway bends the tape in a substantially obtuse angle.

4. A tape cassette as claimed in claim 3, wherein the guide member includes two column members, the first pathway running between the two column members where the guide member guidingly bends the tape into the substantially acute angle and the second pathway running to the outside of both of the column members where the guide member guidingly bends the tape into the substantially obtuse angle.

5. A tape cassette as claimed in claim 4, wherein the tape is an ink-receiving type tape requiring an ink ribbon, the guide member guiding the tape along the second pathway, and further comprising an ink ribbon spool around which is wound the ink ribbon, the column members being provided in the vicinity of the ink ribbon spool.

6. A tape cassette as claimed in claim 5, wherein the column members guide the tape around the ink ribbon spool.

7. A tape cassette as claimed in claim 4, wherein the guide member further includes roller members rotatably mounted on the column members.

8. A tape cassette as claimed in claim 4, wherein the guide member guides a heat-sensitive type tape, which does not require an ink ribbon, through the first pathway and an ink-receiving type, which requires an ink ribbon, through the second pathway.

9. A tape cassette as claimed in claim 4, further comprising:

a thermal head insertion portion for inserting a thermal head of a printing device; and a guide arm for guiding the tape from the guide member to the thermal head insertion portion.

10. A tape cassette as claimed in claim 9, further comprising an upper and a lower regulation member in the thermal head insertion portion for regulating movement of the tape in its width direction.

11. A tape cassette as claimed in claim 10, wherein the upper and lower regulation members are separated by a distance in the width direction equal to a width of the tape.

12. A tape cassette as claimed in claim 3, wherein the guide member guides the tape through the second pathway when the tape has sufficient stiffness such that bending the tape through an acute angle would result in the tape being printed on without being sufficiently drawn out.

13. A tape cassette as claimed in claim 12, further comprising an ink ribbon spool around which is wound an ink ribbon, the guide member being provided in the vicinity of the ink ribbon spool and wherein:

the tape is an ink-receiving type tape requiring the ink ribbon;

the guide member includes two column members; and the first pathway runs between the two column members where the guide member guidingly bends the tape into the substantially acute angle and the second pathway running to the outside of both of the column members where the guide member guidingly bends the tape into the substantially obtuse angle.

14. A tape cassette as claimed in claim 13, wherein the guide member guides a heat-sensitive type tape, which does not require the ink ribbon, through the first pathway and the ink-receiving type through the second pathway.

15. A tape cassette as claimed in claim 3, wherein the guide member guides the tape through the first pathway when the tape has sufficient flexibility such that tilting or vibrating of the printing device could cause the tape to bend in said pathways if said tape is not bent through an acute angle around said guide member.

16. A tape cassette as claimed in claim 15, further comprising an ink ribbon spool around which is wound an ink ribbon, the guide member being provided in the vicinity of the ink ribbon spool and wherein:

the tape is an ink-receiving type tape requiring the ink ribbon;

the guide member includes two column members; and the first pathway runs between the two column members where the guide member guidingly bends the tape into the substantially acute angle and the second pathway running to the outside of both of the column members where the guide member guidingly bends the tape into the substantially obtuse angle.

17. A tape cassette as claimed in claim 16, wherein the guide member guides a heat-sensitive type tape, which does not require an ink ribbon, through the first pathway and the ink-receiving type through the second pathway.

18. A tape cassette as claimed in claim 3, wherein the guide member guides the tape through the second pathway when the tape includes a peel-off sheet.

19. A tape cassette as claimed in claim 18, further comprising an ink ribbon spool around which is wound an ink ribbon, the column member being provided in the vicinity of the ink ribbon spool and wherein:

the tape is an ink-receiving type tape requiring the ink ribbon;

the guide member includes two column members; and the first pathway runs between the two column members where the guide member guidingly bends the tape into the substantially acute angle and the second pathway running to the outside of both of the column members where the guide member guidingly bends the tape into the substantially obtuse angle.

20. A tape cassette as claimed in claim 19, wherein the guide member guides a heat-sensitive type tape, which does not require an ink ribbon, through the first pathway and the ink-receiving type through the second pathway.

21. A tape cassette as claimed in claim 3, wherein the guide member includes two column members, the first pathway running between the two column members where the guide member guidingly bends the tape into the substantially acute angle.

22. A tape cassette as claimed in claim 21, wherein the guide member guides the tape through the first pathway when the tape has sufficient flexibility such that tilting or vibrating of the printing device could cause the tape to bend in said pathways if said tape is not bent through an acute angle around said guide member.

23. A tape cassette as claimed in claim 21, wherein the tape is an ink-receiving type tape requiring an ink ribbon and further comprising an ink ribbon spool around which is wound the ink ribbon, the column members being provided in the vicinity of the ink ribbon spool, the second pathway running to the outside, with respect to the ink ribbon spool, of both of the column members where the guide member guidingly bends the tape into the substantially obtuse angle.

24. A tape cassette as claimed in claim 23, wherein the column members guide the tape around the ink ribbon spool.

25. A tape cassette as claimed in claim 23, wherein the guide member guides a heat-sensitive type tape, which does not require an ink ribbon, through the first pathway and the ink-receiving type through the second pathway.

26. A tape cassette as claimed in claim 1, further including:

a spool around which is wound the elongated tape; and a discharge portion through which the tape is discharged from the tape cassette; wherein the first point is at the spool and the second point is at the discharge portion.

* * * * *